United States Patent [19]

Russo

[11] Patent Number: 4,524,848

[45] Date of Patent: Jun. 25, 1985

[54] DEVICE FOR DETERRING UNAUTHORIZED CLIMBING OF PERMANENT LADDERS

[76] Inventor: John B. Russo, 1123 N. Mesquite, Corpus Christi, Tex. 78475

[21] Appl. No.: 631,384

[22] Filed: Jul. 16, 1984

[51] Int. Cl.[3] ..... E06C 5/32

[52] U.S. Cl. ..... 182/77; 182/92; 182/106

[58] Field of Search ..... 182/106, 230, 83, 93, 182/77, 49

[56] References Cited

U.S. PATENT DOCUMENTS

| | | | |
|---|---|---|---|
| 2,381,569 | 8/1945 | Bowman | 182/106 |
| 2,535,544 | 12/1950 | McKinley | 182/77 |
| 2,539,664 | 1/1951 | Hay | 182/106 |
| 2,880,829 | 4/1959 | Watkins | 182/106 |
| 3,968,857 | 7/1976 | Bryan | 182/106 |
| 4,126,206 | 11/1978 | Becnel | 182/106 |

*Primary Examiner*—Reinaldo P. Machado

*Attorney, Agent, or Firm*—G. Turner Moller

[57] ABSTRACT

A climbing deterrence device is attached to a vertical ladder leading to a water tank or the like. The device is configured to prevent unauthorized people from climbing the ladder and obtaining access to the tank or other structure to which it is attached. The device comprises a cage made of expanded metal and assembled from a plurality pieces that substantially encircle a conventional ladder in such a way that the device cannot be crawled over or through without unlocking a door which normally closes a climbing path through the device.

15 Claims, 7 Drawing Figures

DEVICE FOR DETERRING UNAUTHORIZED CLIMBING OF PERMANENT LADDERS

This invention relates to a device which is attached to a permanent ladder of the type normally affixed on water tanks, smoke stacks, television towers and other tall structures in order to deter vandals or pranksters from climbing the ladder, gaining access to the tall structure and then engaging in some type of mischief. Everyone is familiar with the small town water tank which has been painted by exuberant high school students. Although the device of this invention has other obvious uses, it is this general type of activity that will be deterred by use of this invention.

The prior art is surprisingly bereft of solutions for this problem. The only disclosure known to applicant is in U.S. Pat. No. 3,968,857 which discloses a safety shield for attachment to the permanent ladder of a tank. In this device, a sheet metal structure comprises a pair of side panels rigid with the ladder and a central moveable panel. The moveable panel is hinged along a vertical side and means are provided to lock the panel to the ladder in the closed position. There are a variety of problems associated with this device. First, the device must be attached to the ladder at a location where the back of the ladder is closely spaced to the structure, otherwise an individual may climb on the backside of the ladder. Second, the device is made of sheet metal material and is provided with a horizontally swinging door. If the wind is blowing to any significant extent, one of two things will inevitably happen. If the wind is blowing in a direction tending to close the door, the individual will have a very difficult time moving the door to its opened position and may suffer injury when trying to close the door and to restrain the door from movement during closing. If the wind is blowing in a direction tending to open the door, the user is subject to injury if the door were to fly open and will have considerable difficulty in closing the door.

Other disclosure of some interest are found in U.S. Pat. Nos. 2,381,569; 2,880,829; 4,126,206 and a publication of the Department of Labor known as Osha Safety and Health Standards (29 CFR 1910.27).

The climbing deterrence device of this invention is assembled from a number of components which are conveniently fabricated from metal strap and expanded metal. A front section of the device is conveniently generally cylindrical in shape having an open side which receives the ladder. A back section is attached to the ladder at about the same elevation as the front section. The back section is also conveniently made of expanded metal and metal strap. It is positioned away from the ladder a distance sufficient to receive the foot of an individual climbing the ladder when the rung is received adjacent the individual's heel. In order to prevent someone from climbing between the back section and the ladder, a bar extends horizontally across the back section, generally parallel to the ladder rungs, at a location approximately midway between the ladder and the back of the back section. In order to readily accommodate ladders of different width, the bar is telescoping.

It will accordingly be seen that the device of this invention provides a climbing path on the inside of the generally cylindrical cage. A door is mounted on the device in a generally horizontal which closes the climbing path. In order to free the path for climbing movement, a suitable lock is removed and the door is pivoted to a generally vertical position which allows an individual to climb between the ladder and the front panel.

It is accordingly an object of this invention to provide an improved device for deterring unauthorized people from climbing a permanent ladder attached to a large outdoor structure.

Another object of this invention is to provide a device for deterring the climbing of permanent ladders which is inexpensive to manufacture, which is relatively simple to install and which is cost effective.

Other objects and advantages of this invention will become fully apparent as this description proceeds, reference being to the accompaning drawings and appended claims.

IN THE DRAWINGS

FIG. 5 is another isometric detail view illustrating the latch and locking mechanism of this device;

Figure 1:
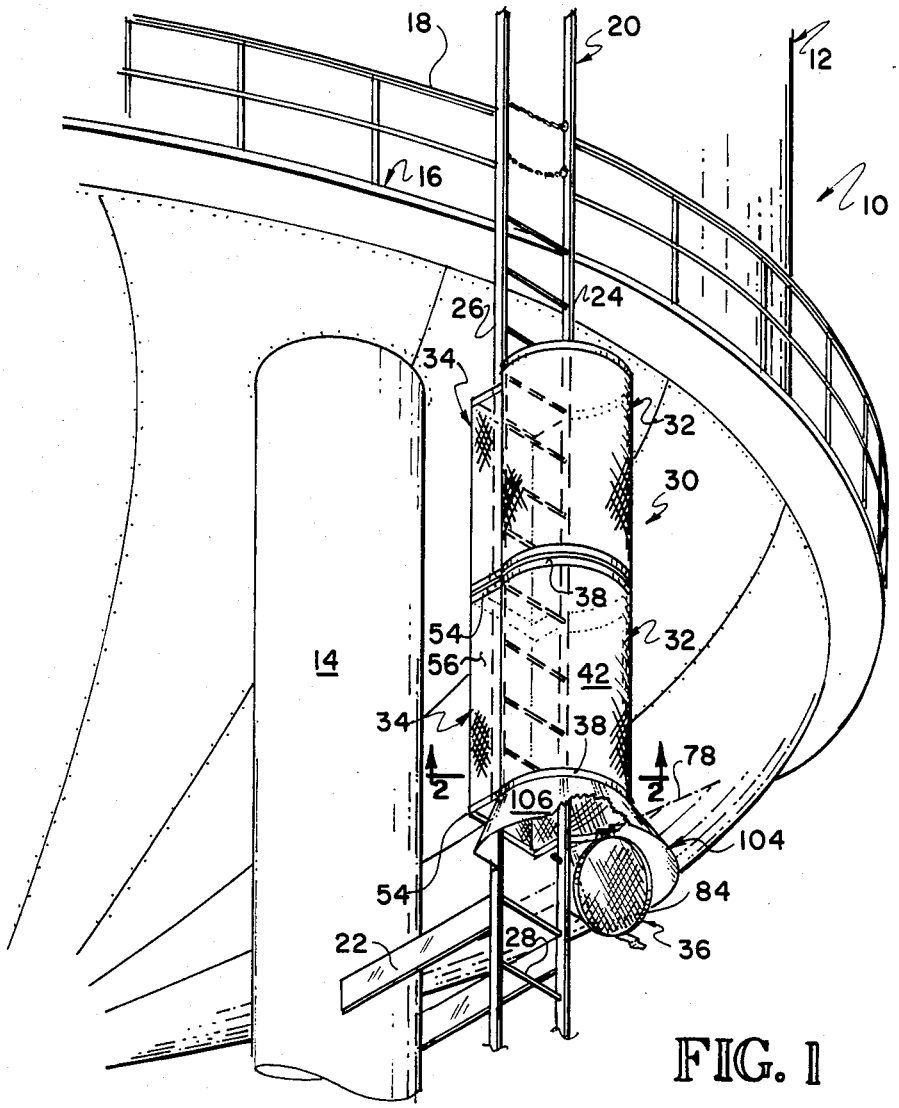
FIG. 1 is an isometric view of a device of this invention attached to a permanent ladder leading to the top of a water tower.

Referring to FIG. 1, there is illustrated a water tank 10 comprising a conventional water container 12 supported from the ground by a plurality of columns 14. Surrounding the container 12 is a walkway 16 having a hand rail 18 therearound. A permanent ladder 20 extends from the walkway 16 downwardly to the ground or adjacent thereto. The ladder 12 is typically secured to the walkway 16 and may be braced against the columns 14 by suitable struts 22. The permanent ladder 20 comprises a pair of vertical side rails 24, 26 interconnected by a series of parallel metal rungs 28. As heretofore described, it will be apparent to those skilled in the art that the tank 10 and ladder 20 are exemplary of the large exterior structures and ladders with which the device of this invention is normally intended to be used.

A device 30 of this invention is attached to the ladder 20 acts to deter unauthorized climbing thereof. In essence, the device 30 establishes a path of climbing movement that is immediately adjacent the ladder 20 and eliminates all alternative reasonable climbing paths. A door is normally closed to block the path of climbing movement and is equipped with a suitable locking mechanism to allow authorized persons to move the door to an unblocking position thereby freeing the climbing path from obstructions.

To these ends, the device 30 comprises, as major components, one or more front sections 32, one or more back sections 34 and a door 36 mounted for pivotal movement between a generally horizontal closed position and a generally vertical open position.

The sections 30 are termed front sections since the ladder 20 is disposed between the sections 30 and the tank 10. The sections 30 are conveniently made of upper and lower somewhat flexible metal straps 38. As shown best in FIG. 2, the metal straps 38 comprise a pair of generally planar ears 40 interconnected by a generally circular section. An expanded metal panel 42 is affixed to the circular portion of the metal straps 38.

An important feature of the front section 32 is that it is capable of being attached to ladders of quite different width. Because the metal straps 38 are inherently somewhat flexible, it will be seen that the spacing between the ears 40 is not fixed so that the ears 40 may be placed inside the side rails 24, 26 of ladders of considerably different width. This is extremely important in controlling costs since the front sections 32 do not have to be custom made to fit a particular ladder and that only one, or at the most two, size front sections 32 need be manufactured.

Figure 3:
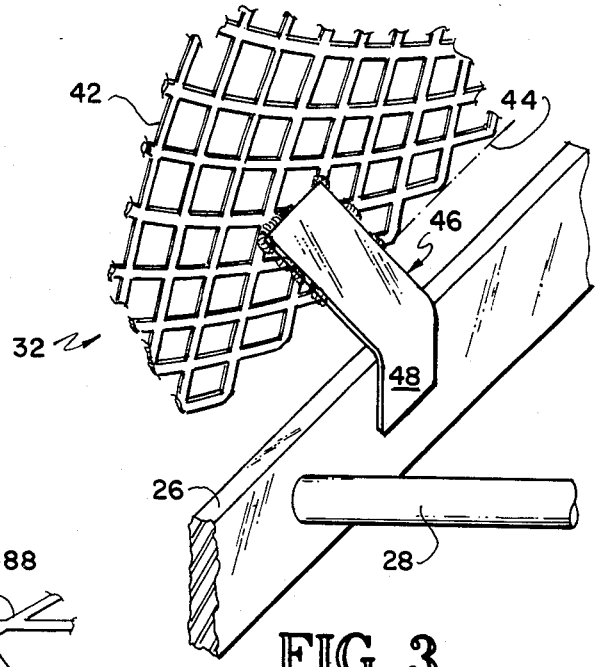
FIG. 3 is an isometric detail view of a central portion of one of the front sections and its interconnection with the ladder.

Referring to FIG. 3, another feature of the front sections 32 is illustrated. Since the front sections 32 are designed to fit on ladders of somewhat different width, the expanded metal panel 42 is not reinforced so that it retains its inherent flexibility. Since the expanded metal panel 42 is originally planar and has been attached, by welding or the like, to the straps 38, it has assumed a generally circular configuration. The expanded metal panel, because of the memory inherent in the material, wants to assume its original planar configuration. This leaves open the possibility that someone could pull the longitudinal edge of the panel 46 away from the ladder side rail 26 and thereby circumvent the device 30.

To avoid this possibility, the front sections 32 include, on both sides thereof, one or more ears 46 which are secured, as by welding or the like, adjacent the edge 44 and which extend inwardly of the ladder side rails 24, 26. The ears 46 conveniently include bent ends 48 which come to rest on the inner side of the ladder side rails 24, 26 and are generally parallel thereto. It will accordingly be seen that the front sections 32, when installed, are lightly biased against the inner side of the side rails 26 since the opposite longitudinal sides of the panel 42 are biased apart.

It is desirable that the device 30 constitute not only a physical barrier to unauthorized climbers but also provide a psychological barrier. To this end, the vertical extent of the device 30 is preferably so great that no reasonable person would be inclined to try to climb around it. On the other hand, the device 30 cannot be made to be so long vertically as to present erection or assembly problems which, after all, will be conducted quite a distance above ground level. It is accordingly preferred that the front sections 32 be of some modest vertical extent, as in the range of 3–6 feet in height, with two or more assembled one above the other to provide the desired vertical extent.

The sections 34 are termed back sections since they reside between the ladder 20 and the tank 10. The back sections 34 are designed to prevent an individual from climbing up the back side of the ladder 20 while providing clearance for the feet of the climber. As shown best in FIG. 2, an outline of a climber's shoe 50 is illustrated in which the rung 28 is disposed adjacent the part of the heel 52, as if the climber's weight were on the shoe 50. It will be seen that the rearmost part of the back section 34 is spaced from the end of the toe of the shoe 50.

To these ends, the back section 34 is preferably of generally rectilinear cross-section rather than generally circular. The back section 34 comprises upper and lower metal straps 54 interconnected by a formed expended metal panel 56.

Figure 2:
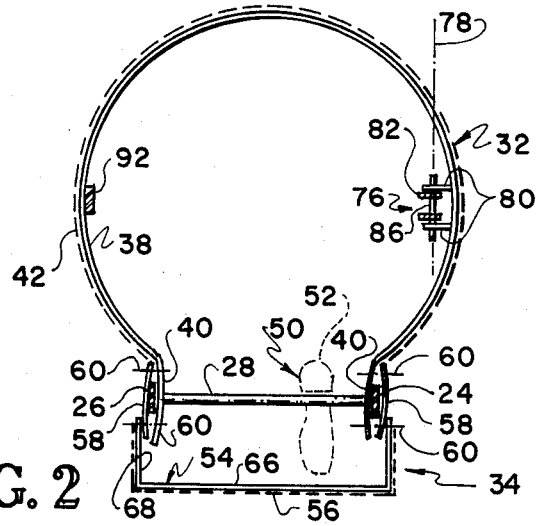
FIG. 2 is an enlarged cross-sectional view of the device of FIG. 1, taken substantially along line 2—2 as viewed in the direction indicated by the arrows.

The metal straps 54 may terminate at about the ends of the expanded metal panel 56 as shown in FIG. 2. A second metallic ear 58 may be provided in order to connect the back sections 34 to the ladder 20. In the embodiment of FIG. 2, suitable threaded fasteners are provided along fastening axes 60 to clamp the front section 32 to the side rails 24, 26 and to attach the back section 34 to the ladder 20.

Figure 4:
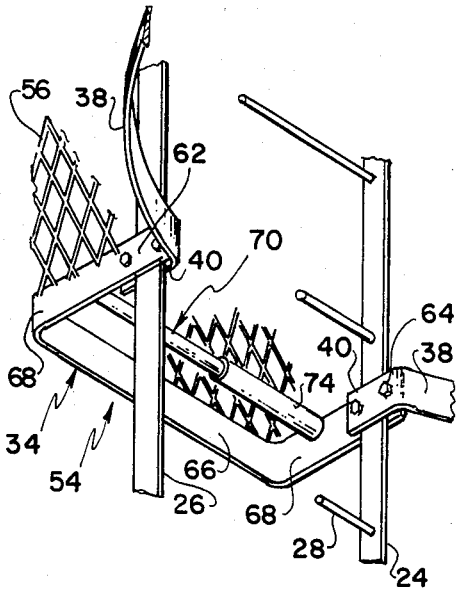
FIG. 4 is another isometric detail view illustrating the back section and a telescoping bar.

In the alternative, the straps 54 may extend beyond the longitudinal edge of the expanded metal panel 56 so that the ends 62 of the straps 54 overlie the ears 40 of the front section straps 30 as shown in FIG. 4. In this arrangement, suitable threaded fasteners 64 are used to clamp the side rails 24, 26 between the ears 40 and the strap ends 62.

Even though the back sections 34 are desirably rectilinear in cross-section, there is a good deal of flexibility afforded by the straps 54, particularly since the central part 66 of the straps 54 will bow if the ends 68 are spread apart or are forced toward each other. Accordingly, the back sections 34 are capable of being used on ladders of considerably different width so that the back sections 34 do not have to be custom made for each installation.

It will be seen that the back sections 34 must provide sufficient clearance for a climber's foot. This space may be a gap of sufficient size which does not deter a small individual from climbing between the back of the ladder 20 and the back section 34. In order to prevent this, a bar or rod 70 extends across the open bottom of the section 34 in a direction generally parallel to the ladder rungs 28. In order to preserve the flexibility of the back sections 34 so they can be assembled on ladders of different width, it is preferred that the bar 70 comprise telescoping sections 72, 74.

The door 36 is provided to close off the normal climbing path inside the device 30 defined between the ladder 20 and the front sections 32. To this end, the door 36 is conveniently mounted to the lowermost metal strap 38 by mounting means 76 which pivot the door 36 about an axis 78 which is generally perpendicular to the plane of the ladder rungs 28. As shown best in FIG. 2, the pivotal mounting means 76 conveniently comprises a pair of brackets 80 affixed to the strap 38 in any suitable fashion, as by welding or the like. A pair of arms 82 attach to a circular strap 84 comprising part of the door 36. A pivot pin 86 extends through aligned openings in the brackets 80 and arms 82 as will be evident to those skilled in the art. An expanded metal piece 88 is secured to the circular strap 84 and provides the physical barrier of the door 36.

Figure 5:
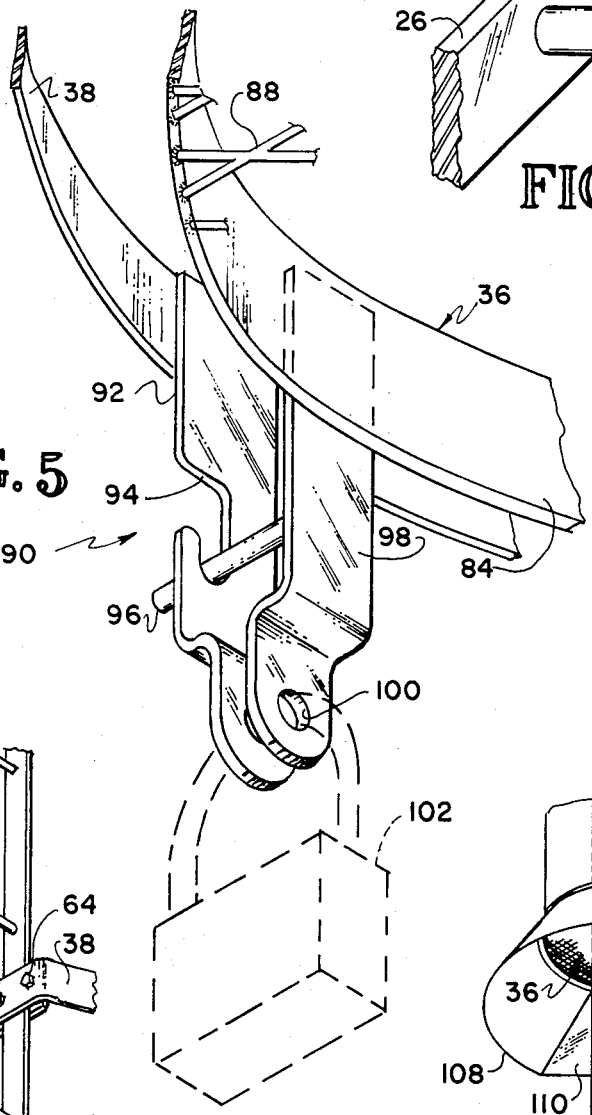
FIG. 5 is an isometric detail view illustrating the latching mechanism.

As shown best in FIG. 5, a latch 90 is provided for holding the door 36 in its closed position. The latch 90 comprises a first member 92 affixed to the strap 38 of the front section 32 opposite from the pivotal mounting means 96. The first member 92 includes an L-shaped slot 94 for receiving a latch pin 96 carried by a second member 98 affixed to the circular strap 84 of the door 36. The first and second members 92, 98 provide aligned apertures 100 for receiving a padlock 102 in the closed position of the door 36.

It will be evident that the door 36 may be moved from its normally closed and locked position merely by unlocking and removing the padlock 102 and lifting the door 36 so that the latch pin 96 moves upwardly in the slot 94. Because there is sufficient play in the door 36 and pivotal mounting means 76, the latch pin 96 is capable of moving out of the slot opening so that the door 36 may move by gravity to its open vertical position shown in FIG. 1.

An important feature of the door 36 is that it hangs, in its open position, in a plane outside of the confines between the ladder side rails 24, 26. It will be seen that this arrangement provides minimal interference with an individual moving past the door 36 while climbing through the opening thereof.

As heretofore described, the device 30 substantially prevents most people from climbing over or around the obstructions presented by the device 30. The purpose, however, of the device 30 is not only to present a difficult task in avoiding the obstructions but, equally as importantly, to provide such a psychological impact that reasonable people will not attempt to circumvent the device 30.

Figure 6:
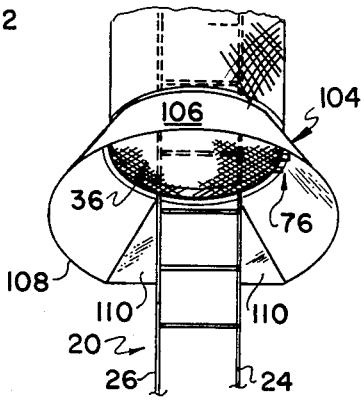
FIG. 6 is a view illustrating the underside of the device of this invention as it may appear to one climbing the ladder.

Additionally to this end, there is provided a frusto-conical shield 104. The shield 104 is desirably made of a sheet metal section 106 and is connected, at the upper end thereof, to the lowermost strap 38 of the front section 32. As shown best in FIG. 6, the sheet metal section 106 diverges downwardly so that the door 36 is recessed relative to the bottom edge 108 thereof. The shield 104 includes a pair of wing sections 110 that provide a transition between the generally frusto-conical configuration of the metal sheet 106 and the vertical flat edges of the ladder side rails 24, 26. Accordingly, the edges of the wings 110 are desirably bolted to the ladder side rails 54, 56.

Figure 7:
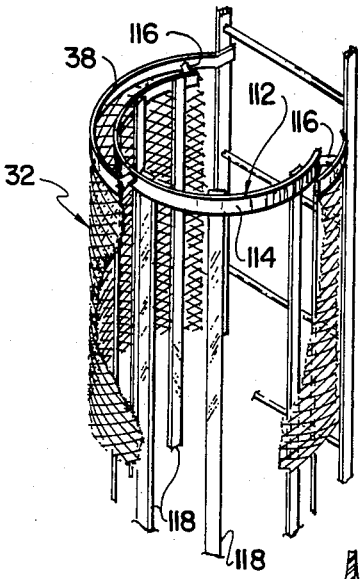
FIG. 7 is a broken isometric view illustrating another embodiment of this invention which incorporates an OSHA type safety cage on the inside of the device of this invention.

Referring to FIG. 7, there is illustrated an OSHA type safety cage 112 positioned inside the front section 32, the back section 34 being omitted for purposes of clarity. The safety cage 112 comprises a band 114 substantially concentric to the metal straps 38 of the front section 32. The band 114 is secured to the strap 38 by suitable fasteners (not shown) extending through a plurality of spacers 116. The spacers 116 manifestly position the band 114 away from the strap 38.

A plurality of generally flat straps 118 extend downwardly from the band 114 to a lower band (not shown). It will accordingly be evident that the safety cage 112 meets OSHA requirements as will be evident to those skilled in the art.

It will accordingly be seen that there is herein provided an improved device for deterring the unauthorized climbing of permanent ladders.

Although the invention has been described in its preferred forms with a certain degree of particularity, it is understood that the present disclosure of these preferred forms is only by way of example and that numerous changes in details of construction and in the combination and arrangement of parts may be resorted to without departing from the spirit and scope of the invention as hereinafter claimed.

I claim:

1. A device to deter climbing of permanent ladders of the type permanently secured to a support structure and having a pair of side rails and a plurality of rungs, comprising a front section having a pair of generally coplanar longitudinal edges and a front panel spanning the longitudinal edges and extending out of the plane thereof to define a climbing path for a human between the front panel and the ladder;

means for securing the front section to the ladder for positioning the longitudinal edges parallel to the ladder side rails and juxtaposed thereto;

a back section, separable from the front section, having a back panel;

means for securing the back section to the ladder at the same elevation as the front section and for positioning the back panel away from the ladder rungs;

means preventing human movement between the back section and the ladder;

a door and means mounting the door for pivotal movement between a first closed position adjacent the front panel closing the climbing path and a second open position unblocking the climbing path; and means for locking the door in the first position.

2. The device of claim 1 wherein the front panel is generally convex toward the plane.

3. The device of claim 2 wherein the front panel is smoothly arcuate.

4. The device of claim 1 wherein the back section comprises a pair of sides transverse to the back panel, the sides being generally parallel to and juxtaposed to the ladder, the preventing means comprising a bar spanning the sides of the back section.

5. The device of claim 4 wherein the bar comprises a telescopingly adjustable bar.

6. The device of claim 1 further comprises means detering climbing over the outside of the device including a downwardly diverging generally frusto-conical section and means securing the frusto-conical section adjacent the bottom of the front section.

7. The device of claim 6 wherein the frusto-conical section includes a pair of ends generally parallel to the ladder.

8. The device of claim 1 further comprising a second front section, substantially identical to the first mentioned front section and means for securing the second first section to the ladder at a location juxtaposed to the upper end of the first front section.

9. The device of claim 8 further comprising a second back section substantially identical to the first back section and means for securing the second back section to the ladder at a location juxtaposed to the upper end of the first back section.

10. The device of claim 1 wherein the door, in the first closed position, is generally horizontal across the climbing path and the door mounting means comprises a pivotal connection for moving the door from the first position toward a generally vertical position comprising the open position.

11. The device of claim 1 wherein the front section comprises a pair of vertically spaced flexible metal straps having ends and the front panel comprises an expanded metal panel affixed to the metal straps, and means for connecting the metal strap ends to the ladder, the metal straps being sufficiently flexible to juxtapose the ends adjacent the side rails of ladders of different width.

12. The device of claim 11 further comprising a pair of ears rigid with the expanded metal panel on opposite sides thereof and intermediate the ends thereof and protruding beyond both longitudinal edges for engaging the ladder side rails and positioning the longitudinal edges generally parallel to the ladder side rails.

13. The device of claim 11 wherein the back section comprises a pair of vertically spaced flexible metal straps having ends and the front panel comprises an expanded metal panel affixed to the metal straps, and means for connecting the metal strap ends to the ladder, the metal straps being sufficiently flexible to juxtapose the ends adjacent the side rails of ladders of different width.

14. The device of claim 13 wherein the securing means comprises means for clamping the metal strap ends about the ladder side rails.

15. The device of claim 11 further comprising a safety cage inside the front section and including an arcuate band, means connecting the arcuate band to one of the flexible metal straps at a distance spaced therefrom and a plurality of vertically extending straps secured to the band.

* * * * *